United States Patent [19]

Webb

[11] 4,025,242

[45] May 24, 1977

[54] VACUUM PUMP OILING

[75] Inventor: David B. Webb, Alamo, Calif.

[73] Assignee: GCA Corporation, Bedford, Mass.

[22] Filed: Oct. 20, 1975

[21] Appl. No.: 623,979

[52] U.S. Cl. ..... 418/13; 418/94; 418/99; 184/7 R

[51] Int. Cl.[2] ..... F01C 21/04; F04C 27/02; F04C 25/02

[58] Field of Search ..... 418/13, 94, 96–99, 418/83, 87; 184/7 R

[56] References Cited

UNITED STATES PATENTS

| | | | |
|---|---|---|---|
| 848,446 | 3/1907 | Crowell | 418/92 |
| 885,783 | 4/1908 | Palmer | 418/98 |
| 1,114,046 | 10/1914 | Roessler | 418/92 |
| 1,640,973 | 8/1927 | Barbarou | 184/7 R |
| 1,953,253 | 4/1934 | Ogilvie | 418/97 |
| 2,195,835 | 4/1940 | Bilderbeck | 418/94 |
| 2,877,947 | 3/1959 | Wessling et al. | 418/13 |
| 2,883,101 | 4/1959 | Kosfeld | 418/94 |
| 3,280,812 | 10/1966 | Përas | 418/94 |
| 3,649,140 | 3/1972 | Harlin | 418/87 |

FOREIGN PATENTS OR APPLICATIONS

| | | | |
|---|---|---|---|
| 1,332,100 | 6/1963 | France | 418/94 |

*Primary Examiner*—John J. Vrablik
*Attorney, Agent, or Firm*—Kenway & Jenney

[57] ABSTRACT

A system is shown for the positive, metered lubrication of the shaft and rotor surfaces in a mechanical vacuum pump. The pump has an end plate which receives the shaft in a cylindrical opening and a lubricant conduit is provided in the end plate communicating with that opening. At a location of the opening's cylindrical surface circumferentially spaced from the lubricant conduit, a recess is provided in that cylindrical surface, the recess extending to the end of that surface adjacent the conventional pump rotor secured to the shaft for rotation therewith. One or more recesses are provided in the shaft itself and each is axially alinged with both the lubricant conduit and a portion of the recess in the cylindrical surface. Thus, upon rotation of the shaft, the recess in the shaft itself receives lubricant from the lubricant conduit and deposits the lubricant in the first-mentioned recess. In multiple stage vacuum pumps, the lubricant conduit is provided in the pump end plate adjacent the first pumping stage so that lubricant will be drawn from stage to stage under the influence of the pressure differential between stages, thereby permitting complete lubrication of the shaft, and of each of the rotors, by the single lubricant delivery system.

8 Claims, 5 Drawing Figures

VACUUM PUMP OILING

BACKGROUND OF THE INVENTION

This invention relates to mechanical vacuum pumps and, more particularly, to an improved system for lubricating the pump's internal moving parts.

Rotary, oil-sealed mechanical vacuum pumps have used the oil bath surrounding the pumping mechanism both to seal gaps between parts and to lubricate various bearing and wear surfaces. In one typical arrangement, the lubrication has been accomplished by introducing oil into the pumping mechanism by leakage through the annular gap between the pump shaft and the bearing within which it rotates, or between the small rotor-to-stator gap or rotor-to-end plate gap. Examples of these lubrication systems can be found in U.S. Pat. Nos. 3,525,578; 3,040,573; 2,877,946; and 2,337,849. Drawbacks common to each of these systems are: no provision for the accurate metering of the amount of oil introduced into the pumping mechanism and no provision for interrupting the admission of oil to the pumping mechanism when the pump is not operating.

Other prior lubricating systems have involved the use of external valve arrangements, with the valves being operated by cams driven by the rotation of the shaft. These systems, of course, are more complex, more expensive, and provide a greater inherent likelihood of mechanical failure.

In view of the foregoing, the principal object of the present invention is to provide a lubrication system for a mechanical vacuum pump that is positive in operation and that delivers a precisely metered amount of lubricant to the pumping mechanism. Further objects are to provide such a lubrication system that is inexpensive to manufacture, that is substantially maintenance-free, and that acts to interrupt the flow of lubricant when the pump is not operating.

SUMMARY OF THE INVENTION

The invention features improvements in a mechanical vacuum pump that comprises a hollow stator, a rotor secured to a shaft for rotation therewith within the stator, an enclosure for the rotor-stator pair, and means for delivering lubricant to the surface of the shaft within the enclosure. The enclosure comprises a plurality of plates, each disposed transverse to the shaft, with a first of the plates having an opening for receiving the shaft. In such a vacuum pump, according to the present invention, the means for delivering lubricant comprise a lubricant conduit in the above-mentioned first plate extending between an exterior surface of that plate and the opening that receives the shaft. A first recess is provided in the opening's surface, the recess extending from a first location that is within the opening and circumferentially spaced apart from the lubricant conduit to a second location at the end of the opening. A second recess of predetermined volume is provided in the surface of the shaft. The second recess is axially aligned with both the lubricant conduit and a portion of the first recess and has a circumferential extent that is less than the circumferential spacing between the lubricant conduit and the first recess. The system described, therefore, enables lubricant of predetermined volumetric doses (defined by the volume of the recess in the shaft) to be transferred from the lubricant conduit to the first recess for flow within that recess to the surface of the shaft within the pumping mechanism. Preferably, the pump is of the oil-sealed type and the first plate is positioned such that the exterior opening of the lubricant conduit is submerged in the oil to enable the continuous supply of oil to the lubricant conduit. In a multiple stage pump, the above-mentioned first plate is preferably an end plate that is adjacent the first stage of the pump, whereby lubricant delivered to the surface of the shaft at the first stage is drawn toward the next pump stage by the pressure differential between the stages. Additional recesses may be provided in the surface of the shaft, each being aligned with both the lubricant conduit and the first recess, whereby a plurality of doses of lubricant may be transferred from the lubricant conduit to the first recess during each revolution of the shaft.

BRIEF DESCRIPTION OF THE DRAWINGS

The foregoing and other objects, features, and advantages of the present invention will appear from the description below of a particular preferred embodiment, which is illustrated in the accompanying drawings. In the drawings.

DETAILED DESCRIPTION OF A PARTICULAR PREFERRED EMBODIMENT

Figure 1:
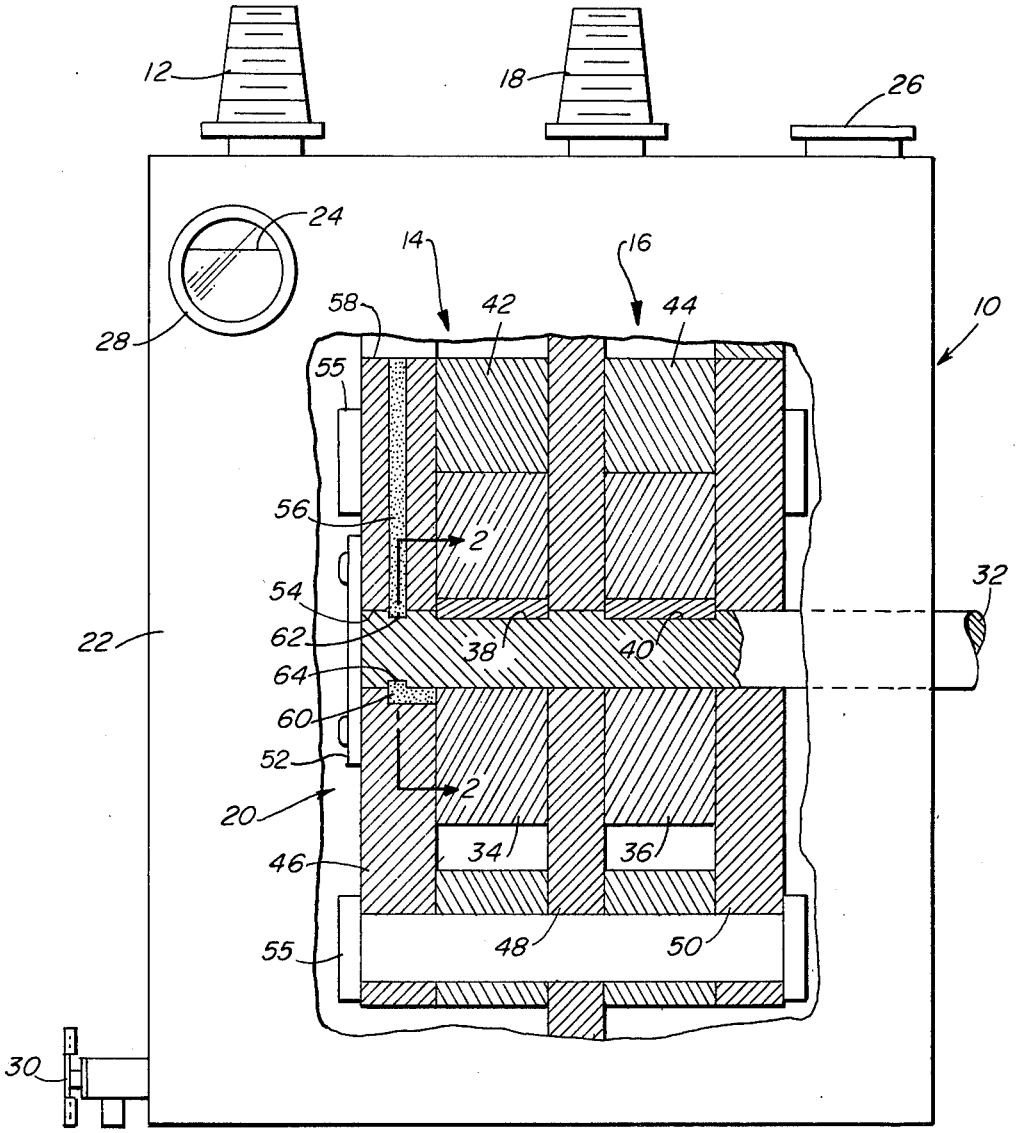
FIG. 1 is a partially broken-away side elevation of a mechanical vacuum pump incorporating the improved lubrication system of the present invention.
Figure 2A:
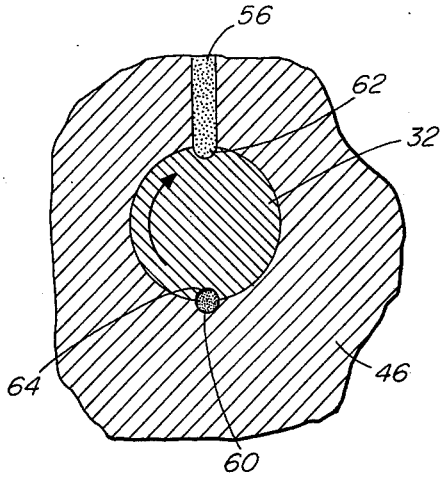
FIGS. 2A–D are enlarged fractional views, taken at 2—2 of FIG. 1, illustrating the operation of the lubrication system as the pump shaft rotates.
Figure 2B:
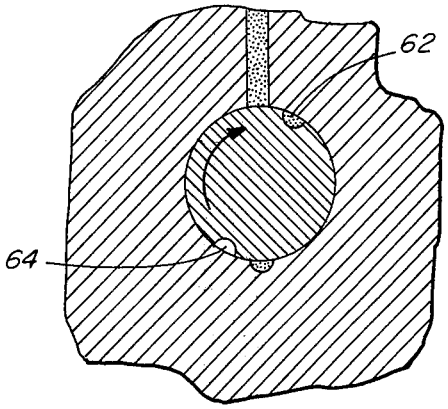
Figure 2C:
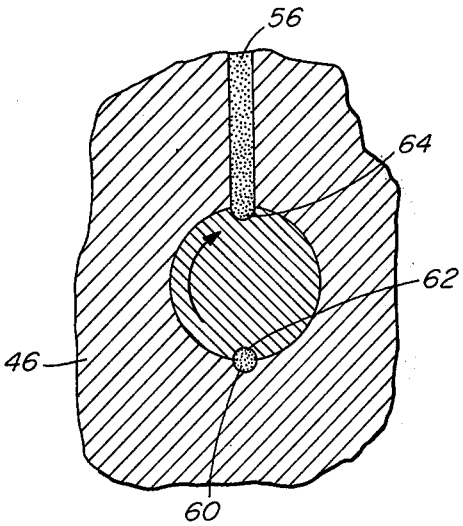
Figure 2D:
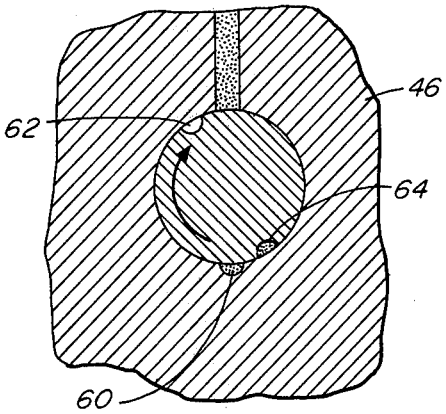

Referring to the drawings, FIG. 1 is a somewhat idealized broken-away view of a two stage, mechanical, oil-sealed vacuum pump 10. Since they are not necessary for an understanding of the present invention and would only complicate the drawings and description, many conventional features of such pumps have been deleted from FIG. 1, including the conduits for the flow of air from the pump inlet 12 to the first stage 14, from the first stage 14 to the second stage 16, and from the second 16 to the pump outlet 18. The general construction of the pump 10 consists of a pumping mechanism 20 supported within a liquid-tight housing 22 and submerged within a volume of oil which fills the housing 22 to a level, indicated at 24, such that the pumping mechanism 20 is completely submerged in the oil. Conventional oil handling features are included, such as an oil fill port and plug 26, a transparent oil-level observation window 28, and an oil drain spout and valve 30.

Pumping mechanism 20 comprises a shaft 32 having an end that projects outwardly from the housing 22, through a conventional bearing and seal arrangement, for connection to a motor (either directly or through a conventional pulley arrangement). A pair or rotors 34 and 36, corresponding to the pumping stages 14 and 16, are keyed in keyways 38, 40 provided in the surface of shaft 32. The rotors 34, 36 are eccentrically disposed within chambers in hollow stators 42 and 44, respectively. Each rotor has a plurality of conventional outwardly biased vanes (not shown), which engage the interior surface of the associated stator. A series of vertically arranged plates 46, 48, 50 are disposed transverse to the axis of shaft 32, with the shaft passing through an opening provided in each of the plates. The plates, as well as exterior stator surfaces, define an enclosure for the pumping mechanism with each pumping stage being sandwiched between a pair of plates (e.g., rotor 34 and stator 42 defining pumping stage 14 are sandwiched between end plate 46 and center plate 48). The air passages between stage 14 and stage 16, not shown, are typically provided in the center plate 48. An end cap 52, secured to an exterior surface of end plate 46, seals the cylindrical opening 54, in end plate 46, that receives the shaft 32. A series of bolts 55, each passing through the plates and the stators, maintains the pumping mechanism 20 as a substantially fluid-tight unit.

A vertically disposed lubricant conduit 56 is provided within end plate 46 and extends from an exterior surface 58 of the end plate to the peripheral surface of the cylindrical opening 54. A first recess, in the form of an axial groove or slot 60, is provided in the cylindrical surface of opening 54 at a circumferential location that is diametrically opposed to the location of conduit 56. The slot 60 extends from the axial position of the conduit 56 (i.e., from the midpoint of the thickness of end plate 46 in the illustrated embodiment) to the end of opening 54 adjacent the rotor 34 of the first stage 14 (i.e., to the inner face of end plate 46). A pair of recesses 62, 64, in the form of circular depressions or radially-facing pockets, in the surface of shaft 32 are axially aligned with both the lubricant conduit 56 and a portion of the slot 60. In the illustrated embodiment, the recess 62, 64 are located 180° apart around the circumference of the shaft 32.

The operation of the lubricating system described in the preceding paragraph is as follows. Because the surface 58 is submerged beneath the surface of the oil bath within the housing 22, oil is continuously supplied to the conduit 56. Referring to FIGS. 2A–D, as the shaft 32 rotates during the operation of the vacuum pump, each of the recesses 62, 64 in the shaft will successively receive a dose of oil from the conduit 56 and, after 180° rotation of the shaft, deliver that dose to the recess 60. The oil can then flow along the recess 60 parallel to the shaft 32 to reach the rotor 34. A portion of this oil can work its way between the end plate 46 and the rotor 34 to lubricate that interface. The keyway 38 provides a path for oil to travel past the rotor 34 (to the right in FIG. 1) for lubrication of the interface of rotor 34 and center plate 48, as well as for lubrication of the bearing and wear surfaces of the second pumping stage 16.

Thus, the lubrication system described delivers precisely metered doses of oil, with the size of the doses and the timing of the delivery of doses being easily optimized by the choices of the number of recesses in the shaft 32, their volume, and their circumferential orientation relative to the keyway 38. Additionally, as long as no recess in the shaft 32 has a circumferential extent equal to the circumferential spacing of the conduit 56 and the slot 60 (i.e., 180° in the embodiment of FIG. 1) delivery of oil to the internal surfaces of the pumping mechanism 20 will cease, as is desired, when the rotation of the shaft 32 ceases.

While a particular preferred embodiment has been illustrated in the accompanying drawings and described in detail herein, other embodiments are within the scope of the invention and the following claims.

I claim:

1. In a mechanical vacuum pump comprising a hollow stator, a rotor secured to a shaft for rotation therewith within said stator, an enclosure for said rotor and stator comprising a plurality of plates each disposed transverse to said shaft, a first of said plates having an opening for receiving said shaft, and means for delivering lubricant to the surface of said shaft within said enclosure, the improvement wherein said means comprise a lubricant conduit in said first plate having an inlet in an exterior surface of said first plate at a location spaced apart from said shaft and an outlet at said opening, a first recess in the surface of said opening extending from a first location within said opening but spaced apart from said lubricant conduit circumferentially around said opening's surface to a second location at the inner end of said opening, and a second recess of predetermined volume in the surface of said shaft, said second recess being axially aligned with both said lubricant conduit and a portion of said first recess and having a circumferential extend less than the circumferential spacing of said lubricant conduit and said first recess, thereby enabling lubricant doses of predetermined volume to be transferred from said lubricant conduit to said first recess.

2. The improved mechanical vacuum pump of claim 1 wherein said vacuum pump is of the oil-sealed type, said exterior surface of said first plate being submerged in oil to enable the continuous supply of oil to said lubricant conduit.

3. The improved mechanical vacuum pump of claim 1 wherein there are provided a plurality of second recesses in the surface of said shaft each being axially aligned with both said lubricant conduit and a portion of said first recess and each having a circumferential extent less than the circumferential spacing of said lubricant conduit and said first recess, thereby enabling a plurality of doses of lubricant to be transferred from said lubricant conduit to said first recess during each revolution of said shaft.

4. The improved mechanical vacuum pump of claim 1 wherein the pump is a multiple stage pump having a plurality of rotor-stator pairs spaced apart along said shaft, said plurality of plates comprising end plates and a plate intermediate each pair of adjacent pump states, said first plate being the end plate that is adjacent the first pump stage, whereby lubricant delivered to the surface of said shaft at the first pump stage is drawn toward the next pump stage by the pressure differential between stages.

5. The improved mechanical vacuum pump of claim 1 further including means for transmitting lubricant along said shaft past said rotor.

6. The improved mechanical vacuum pump of claim 5 wherein said shaft includes a keyway for receiving a key of said rotor, said keyway comprising said means for transmitting lubricant along said shaft past said rotor.

7. In an oil sealed mechanical vacuum pump of the type having a rotor mounted on a shaft for rotation within an eccentric chamber in a stator member, there being at least one end plate abutting the rotor with the shaft extending into a generally cylindrical opening in the end plate, the improvement wherein:

said end plate has a lubricant conduit extending from the exterior of the plate at a location spaced apart from said shaft to a first point in the peripheral surface of said cylindrical opening;

said plate also has an axial groove extending from a second point in the peripheral surface of said cylindrical opening to the inner face of said end plate, said second point being angularly displaced from but axially aligned with said first point; and the portion of said shaft extending into said end plate has a radially-facing pocket which, as the shaft rotates, moves alternately into registration with said conduit at said first point and said groove at said second point, whereby predetermined doses of lubricant are transferred to the rotor at the inner face of said end plate.

8. In a multiple stage, oil-sealed mechanical vacuum pump comprising hollow stators, rotors secured in keyways in a shaft for rotation therewith, each rotor disposed within a stator, an enclosure for said rotors and stators comprising a plurality of plates each disposed transverse to said shaft, a first of said plates having an opening for receiving said shaft, and means for delivering lubricant to the surface of said shaft within said enclosure, the improvement wherein said means comprise an oil conduit in said first plate having an inlet in an exterior surface of said first plate at a location spaced apart from said shaft and an outlet at said opening, said exterior surface being submerged in oil to enable the continuous supply of oil to said oil conduit, said first plate being an end plate adjacent the first pump stage, a first recess in the surface of said opening extending from a first location within said opening but spaced apart from said oil conduit circumferentially around said opening's surface to a second location at the inner end of said opening, and a second recess of predetermined volume in the surface of said shaft, said second recess being axially aligned with both said oil conduit and a portion of said first recess and having a circumferential extent less than the circumferential spacing of said oil conduit said first recess, thereby enabling oil doses of predetermined volume to be transferred from said oil conduit to said first recess.

* * * * *